US010385640B2

(12) United States Patent
Pray et al.

(10) Patent No.: US 10,385,640 B2
(45) Date of Patent: Aug. 20, 2019

(54) TENSION CUTTING CASING AND WELLHEAD RETRIEVAL SYSTEM

(71) Applicant: Weatherford Technology Holdings LLC, Houston, TX (US)

(72) Inventors: Jeffery Scott Pray, Shenandoah, TX (US); Anthony T. Mack, Ann Arbor, MI (US); Richard J. Segura, Broussand, LA (US); David W. Teale, Spring, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 171 days.

(21) Appl. No.: 15/403,000

(22) Filed: Jan. 10, 2017

(65) Prior Publication Data

US 2018/0195359 A1 Jul. 12, 2018

(51) Int. Cl.

| | |
|---|---|
| ***E21B 31/16*** | (2006.01) |
| ***E21B 29/00*** | (2006.01) |
| ***E21B 23/01*** | (2006.01) |
| ***E21B 31/18*** | (2006.01) |
| ***E21B 33/038*** | (2006.01) |

(52) U.S. Cl.

CPC ..... *E21B 31/16* (2013.01); *E21B 23/01* (2013.01); *E21B 29/002* (2013.01); *E21B 29/005* (2013.01); *E21B 31/18* (2013.01); *E21B 33/038* (2013.01)

(58) Field of Classification Search

CPC ..... E21B 31/16; E21B 33/038; E21B 29/005; E21B 23/01; E21B 29/002; E21B 31/08

See application file for complete search history.

(56) References Cited

U.S. PATENT DOCUMENTS

| | | | |
|---|---|---|---|
| 3,052,024 | A | 9/1962 | Courtney |
| 4,550,781 | A | 11/1985 | Kagler, Jr. |
| 5,101,895 | A | 4/1992 | Gilbert |
| 5,146,989 | A | 9/1992 | Rouse |
| 5,318,115 | A | 6/1994 | Rouse |
| 5,360,292 | A | 11/1994 | Allen et al. |
| 5,381,631 | A | 1/1995 | Raghavan et al. |
| 6,029,745 | A | 2/2000 | Broussard et al. |
| 6,056,049 | A | 5/2000 | Davis |

(Continued)

FOREIGN PATENT DOCUMENTS

| | | | |
|---|---|---|---|
| EP | 0885344 | A1 | 12/1998 |
| EP | 1312752 | A2 | 5/2003 |

(Continued)

OTHER PUBLICATIONS

Claxton SABRE™ abrasive water Jet cold cutting system brochure, date unknown, 2 pages.

(Continued)

*Primary Examiner* — Brad Harcourt

(74) *Attorney, Agent, or Firm* — Patterson + Sheridan, LLP

(57) ABSTRACT

An apparatus for use in a well includes a tubular mandrel configured to connect to a downhole assembly. An outer hub is configured to attach to a wellhead and has a bore therethrough. An inner housing is disposed on the tubular mandrel and configured to attach the outer hub to the wellhead. A clutch assembly is disposed within the bore of the outer hub and movable between a locked position and an unlocked position, wherein the tubular mandrel is rotatable relative to the inner housing to operate the downhole assembly in the unlocked position.

22 Claims, 10 Drawing Sheets

(56) References Cited

U.S. PATENT DOCUMENTS

| | | | |
|---|---|---|---|
| 6,330,919 | B1 | 12/2001 | McGarian |
| 6,357,528 | B1 | 3/2002 | Davis et al. |
| 6,516,878 | B1 | 2/2003 | McGarian et al. |
| 6,554,073 | B2 | 4/2003 | McGarian |
| 6,629,565 | B2 | 10/2003 | Harrell |
| 7,090,019 | B2 | 8/2006 | Barrow et al. |
| 7,178,598 | B2 | 2/2007 | Lund et al. |
| 7,258,597 | B2 | 8/2007 | Benson |
| 7,757,754 | B2 | 7/2010 | McKay |
| 7,762,330 | B2 | 7/2010 | Saylor, III et al. |
| 8,307,903 | B2 | 11/2012 | Redlinger et al. |
| 8,365,826 | B2 | 2/2013 | Braddick |
| 8,403,038 | B2 | 3/2013 | Russell et al. |
| 8,403,061 | B2 | 3/2013 | Russell et al. |
| 8,527,100 | B2 | 9/2013 | Russell et al. |
| 8,662,182 | B2 | 3/2014 | Redlinger et al. |
| 8,869,896 | B2 | 10/2014 | Crow et al. |
| 8,881,818 | B2 | 11/2014 | Crow et al. |
| 8,881,819 | B2 | 11/2014 | Crow et al. |
| 8,893,791 | B2 | 11/2014 | Crow et al. |
| 8,967,270 | B2 | 3/2015 | Desai et al. |
| 8,985,230 | B2 | 3/2015 | Crow et al. |
| 9,416,635 | B2 | 8/2016 | Hekelaar |
| 9,464,496 | B2 | 10/2016 | O'Rourke et al. |
| 2010/0326665 | A1 | 12/2010 | Redlinger et al. |
| 2014/0027117 | A1 | 1/2014 | Hekelaar |
| 2014/0158367 | A1 | 6/2014 | Stokes et al. |
| 2014/0251616 | A1 | 9/2014 | O'Rourke et al. |
| 2014/0352976 | A1 | 12/2014 | Tinnen |
| 2015/0034317 | A1 | 2/2015 | Skjold |
| 2016/0076327 | A1 | 3/2016 | Glaser et al. |
| 2016/0168924 | A1 | 6/2016 | Glaser et al. |
| 2016/0312561 | A1 | 10/2016 | Miller et al. |

FOREIGN PATENT DOCUMENTS

| | | | |
|---|---|---|---|
| EP | 1509673 | A1 | 3/2005 |
| EP | 2281998 | A2 | 2/2011 |
| EP | 2288471 | A1 | 3/2011 |
| EP | 2288472 | A1 | 3/2011 |
| GB | 2310873 | A | 9/1997 |
| GB | 2458785 | A | 10/2009 |
| GB | 2458786 | A | 10/2009 |
| GB | 2463849 | A | 3/2010 |
| GB | 2479318 | A | 10/2011 |
| NO | 314733 | B1 | 5/2003 |
| NO | 327223 | B1 | 5/2009 |
| WO | 02 064940 | A1 | 8/2002 |
| WO | 2009/028953 | A1 | 3/2009 |
| WO | 2009/122202 | A1 | 10/2009 |
| WO | 2009/122203 | A1 | 10/2009 |
| WO | 2011 031164 | A1 | 3/2011 |
| WO | 2013 133718 | A1 | 9/2013 |
| WO | 2016203274 | A1 | 12/2016 |

OTHER PUBLICATIONS

Oceaneering article on Website—"Oceaneering to Acquire Norse Cutting & Abandonment AS," Mar. 7, 2011, http://www.oceaneering.com/, 3 pages.

Proserv Marine—"Proserv 7" Multi-String Cutting (MSC) 2.0 Tool" Product Specification Sheet, date unknown, 1 page.

Proserv Marine brochure—"Cutting edge engineering for harsh environments," date unknown, 2 pages.

Proserv Subsea Systems & Services—"Proserv Multi-String Cutting (MSC) Tool," Product Specification Sheet, date unknown, 1 page.

PCT International Search Report and Written Opinion dated Apr. 26, 2018, for International Application No. PCT/US2018/012904.

TENSION CUTTING CASING AND WELLHEAD RETRIEVAL SYSTEM

BACKGROUND OF THE INVENTION

Field of the Invention

The present disclosure generally relates to methods and apparatus for cutting and retrieving a tubular in a wellbore, including retrieval of a wellhead from a well.

Description of the Related Art

A wellbore is formed to access hydrocarbon bearing formations, e.g. crude oil and/or natural gas, by the use of drilling. Drilling is accomplished by utilizing a drill bit that is mounted on the end of a tubular string, such as a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed, and a section of casing is lowered into the wellbore. An annulus is thus formed between the string of casing and the formation. The casing string is temporarily hung from the surface of the well. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

It is common to employ more than one string of casing in a wellbore. In this respect, the well is drilled to a first designated depth with the drill string. The drill string is removed. A first string of casing is then run into the wellbore and set in the drilled-out portion of the wellbore, and cement is circulated into the annulus behind the casing string. Next, the well is drilled to a second designated depth, and a second string of casing or liner, is run into the drilled-out portion of the wellbore. If the second string is a liner string, the liner is set at a depth such that the upper portion of the second string of casing overlaps the lower portion of the first string of casing. The liner string may then be fixed, or "hung" off of the existing casing by the use of slips which utilize slip members and cones to frictionally affix the new string of liner in the wellbore. If the second string is a casing string, the casing string may be hung off of a wellhead. This process is typically repeated with additional casing/liner strings until the well has been drilled to total depth. In this manner, wells are typically formed with two or more strings of casing/liner of an ever-decreasing diameter.

After the production of a well is finished, the well is closed and abandoned. The well closing process typically includes recovering the wellhead from the well using a conventional wellhead retrieval operation. During the conventional wellhead retrieval operation, a retrieval assembly equipped with a casing cutter is lowered on a work string from a rig until the retrieval assembly is positioned over the wellhead. Next, the casing cutter is lowered into the wellbore as the retrieval assembly is lowered onto the wellhead. The casing cutter is actuated to cut the casing. Even though the wellhead may be removed in this manner, the casing may require a tension force to enhance the cutting ability of the casing cutter. Therefore, there is a need for an improved method and apparatus for tension cutting casing and wellhead retrieval.

SUMMARY OF THE INVENTION

The present invention generally relates to methods and apparatus for cutting and retrieving a tubular in a wellbore, including wellhead retrieval from a well.

In one embodiment, an apparatus for use in a well includes a tubular mandrel configured to connect to a downhole assembly, an outer hub having a bore therethrough and configured to attach to a wellhead, an inner housing disposed on the tubular mandrel and configured to attach the outer hub to the wellhead, and a clutch assembly disposed within the bore of the outer hub and movable between a locked position and an unlocked position, wherein the tubular mandrel is rotatable relative to the inner housing to operate the downhole assembly in the unlocked position.

In another embodiment, a method of performing an operation in a well includes attaching a tool to a wellhead, wherein the tool comprises an inner housing and an outer hub and is connected to a tubular mandrel, applying an axial force to the tubular mandrel to disengage a clutch assembly disposed within a bore of the outer hub, and rotating the tubular mandrel relative to the tool thereby operating a downhole assembly.

In another embodiment, an apparatus for use in a well includes a tubular mandrel configured to connect to a downhole assembly, an outer hub having a bore therethrough and configured to attach to a wellhead, an inner housing disposed on the tubular mandrel and configured to attach the outer hub to the wellhead, and a clutch assembly configured to engage the inner housing and rotationally couple the inner housing to the tubular mandrel in a locked position.

In another embodiment, an apparatus for use in a well includes a tubular mandrel, a housing disposed about the tubular mandrel, a latch member for engaging a subsea wellhead, and a clutch assembly rotationally coupling the tubular mandrel to the housing and movable to an unlocked position wherein the tubular mandrel is allowed to rotate relative to the housing.

In another embodiment, a method of latching to a wellhead includes positioning a tool proximate a wellhead, the tool comprising at least one latch member and at least one locking member, rotating the locking member relative to the latch member, and moving the at least one latch member from an unlatched position to a latched position in which the at least one latch member engages the wellhead.

In yet another embodiment, an apparatus for use with a wellhead includes a tubular mandrel, a latch member disposed about the tubular mandrel and movable between an unlatched position and a latched position, wherein the latch member engages the wellhead, and a locking member rotatable relative to the latch member.

In yet another embodiment, a method of performing an operation in a well includes positioning a tool proximate a wellhead, wherein the tool has at least one latch member and a locking member, and wherein the tool is attached to a downhole assembly, rotating the locking member relative to the latch member, moving the at least one latch member from an unlatched position to a latched position in which the at least one latch member engages the wellhead, performing the operation in the well by utilizing the downhole assembly.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
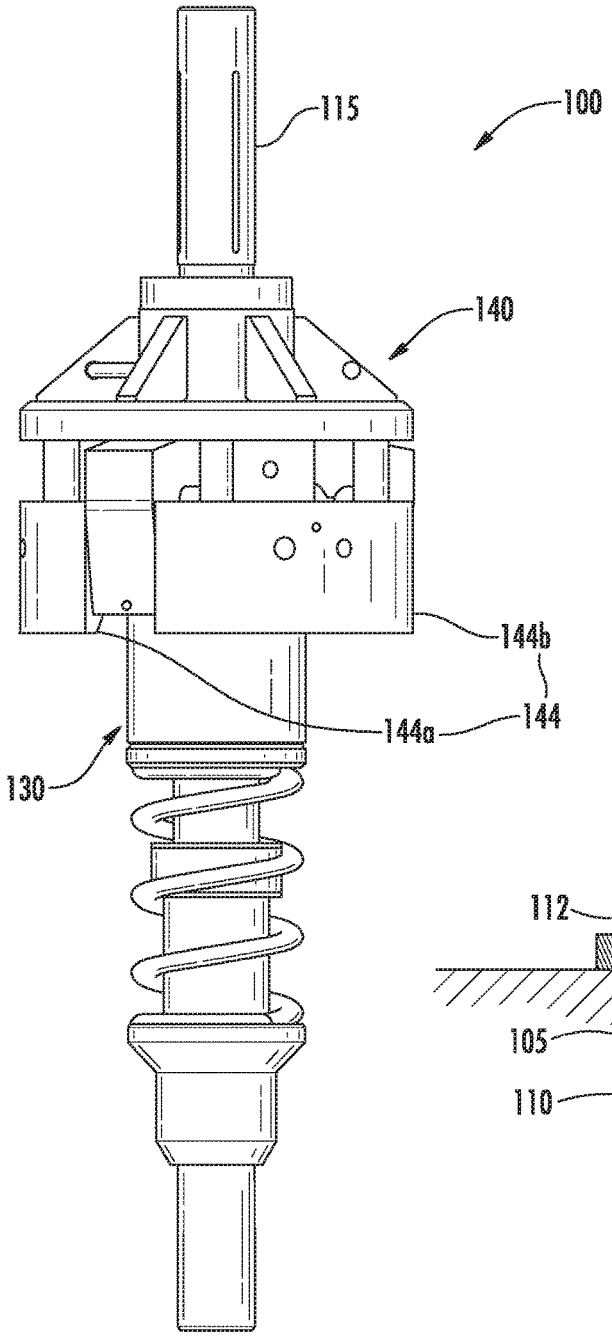
FIG. 1A is an isometric view of the tension cutting casing and wellhead retrieval system according to one embodiment.
Figure 1B:
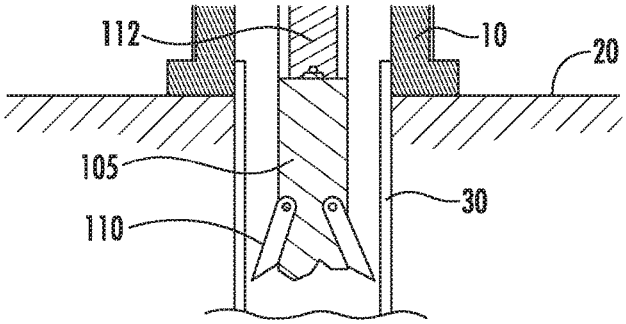
FIG. 1B is a cross section view of a rotary cutter assembly of the system, according to one embodiment.

FIG. 1A illustrates a tension cutting casing and wellhead retrieval system 100, according to one embodiment of the invention. Referring to FIG. 1B, the work string is used to lower the system 100 into the sea to a position adjacent a subsea wellhead 10 located on the seafloor 20. The system 100 may be attached to a downhole assembly, such as a rotary cutter assembly 105. Alternatively, the downhole assembly may include any tool capable of operating by rotation. The downhole assembly may be used to perform an operation in a well. For example, the downhole assembly may be used to perform an operation in a subsea well. For instance, the downhole assembly may include the rotary cutter assembly 105 for cutting a casing string 30 attached to the wellhead 10. The rotary cutter assembly 105 may be actuated by rotation of the work string at the rig. Rotation of the work string may be performed by a top drive, a rotary table, or any other tool sufficient to provide rotation to the work string. In another embodiment, the downhole assembly may also include a motor, such as a mud motor 112 for actuating the rotary cutter assembly 105. The rotary cutter assembly 105 includes a plurality of blades 110 which are used to cut the casing 30. The blades 110 are movable between a retracted position and an extended position. In another embodiment, the system 100 may use an abrasive cutting device to cut the casing instead of the rotary cutter assembly 105. The abrasive cutting device may include a high pressure nozzle configured to output high pressure fluid to cut the casing. In another embodiment, the system 100 may use a high energy source such as laser, high power light, or plasma to cut the casing. Suitable cutting systems may use well fluids, and/or water to cut through multiple casings, cement, and voids. Alternatively, the wellhead may be located at the surface.

Referring to FIGS. 1A-3A, the system 100 includes a mandrel 115, a clutch assembly 120, an inner housing 130, a cap section 137, an outer hub 140, and a biasing member, such as spring 150. Referring to FIG. 2A, the mandrel 115 may be tubular having a bore therethrough. The mandrel may have threaded couplings formed at longitudinal ends for coupling to the work string at an upper end and the downhole assembly, including the rotary cutter assembly 105 at a lower end. A circular groove may be formed around the circumference of the mandrel 115. The mandrel 115 may have shoulders 118, 119 formed along the outer surface thereof. The shoulders 118, 119 may have threads formed on an outer circumference thereof. Retaining members 146, 147 may be coupled to the mandrel 115 at the shoulders 118, 119, respectively. Retaining members 146, 147 may have corresponding threads on an inner surface thereof for coupling to the threads on the shoulders 118, 119. As shown in FIG. 3B, the mandrel 115 may include a longitudinal recess 116 and a longitudinal slot 117. The longitudinal recess 116 may be formed in the groove of the mandrel 115. The longitudinal slot 117 may be formed in the outer surface of the mandrel 115.

Figure 2A:
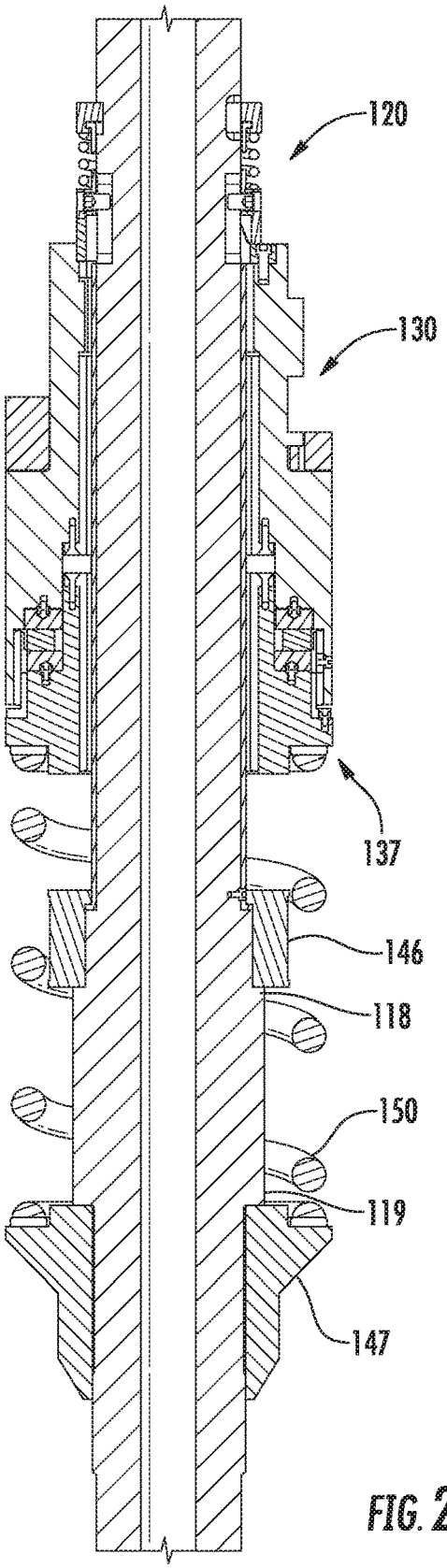
FIG. 2A is a cross section view of the tension cutting casing and wellhead retrieval system, with the outer hub removed for clarity.
Figure 2B:
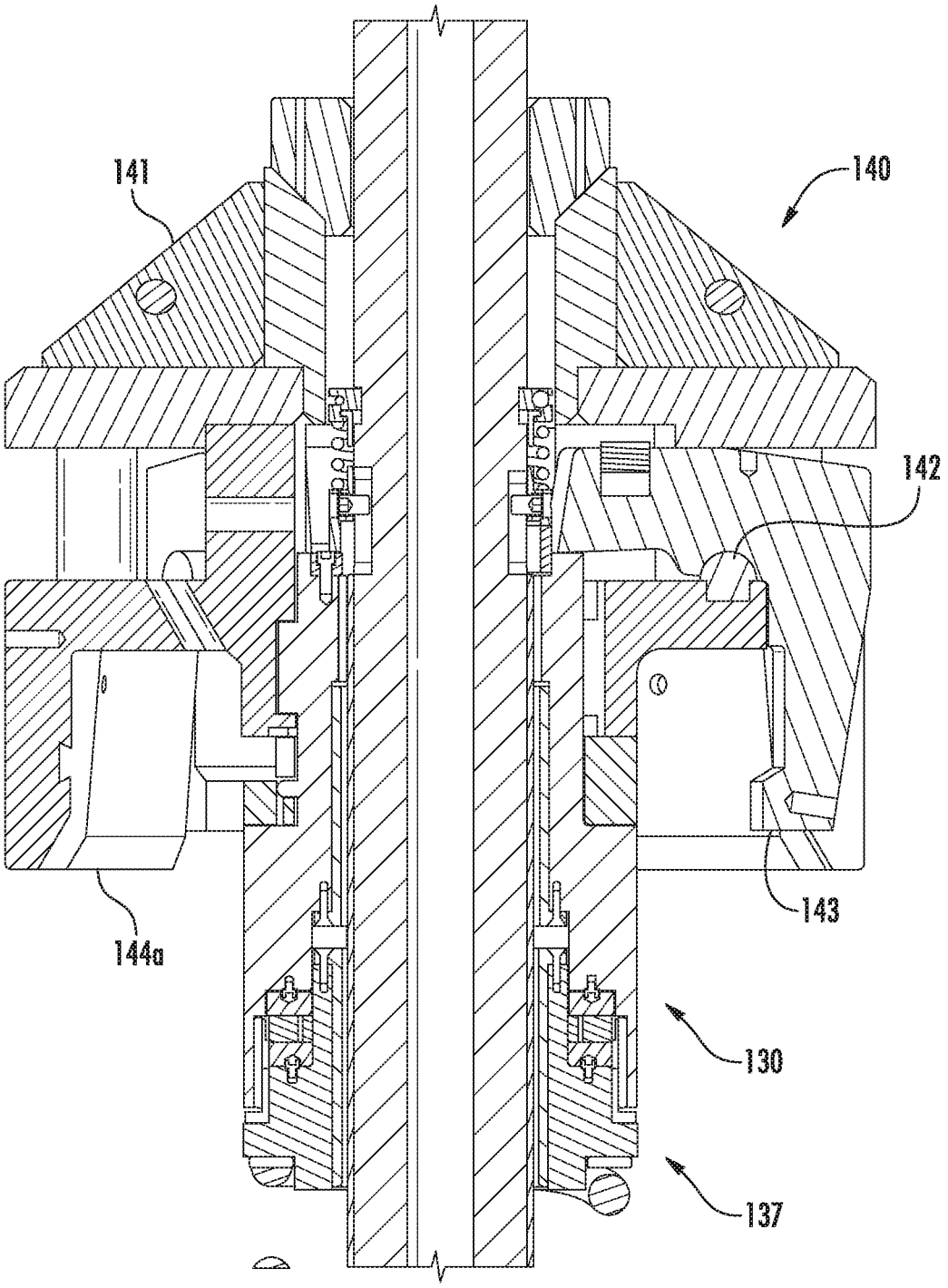
FIG. 2B is an enlarged cross section view of the tension cutting casing and wellhead retrieval system.

FIGS. 1A and 2B illustrate the outer hub 140. The outer hub 140 may be used to attach the system 100 to the wellhead. The outer hub 140 may include a hub housing 141, a pivot 142, and a latch member for engaging and attaching to the wellhead, such as arm 143. The mandrel 115 may be at least partially disposed in a bore of the outer hub 140. The hub housing 141 may include an upper section and a lower section. The lower section of the hub housing 141 may include a frame 144. Frame 144 may include at least two ring arcs 144*a,b* having gaps formed between for placement of the arm 143. The arm 143 may rotate around pivot 142 from an unlatched position to a latched position in order to engage and attach the outer hub 140 to the wellhead 10. Generally, the wellhead 10 includes a profile at an upper end. The wellhead profile may be formed on an outer surface of the wellhead 10. The profile may have different configurations depending on which company manufactured the wellhead 10. The arm 143 of the system 100 includes a matching profile to engage the wellhead 10 during the wellhead retrieval operation. It should be noted that the arm 143 or the profile on the arm 143 may be changed with a different profile in order to match the specific profile on the wellhead of interest.

FIGS. 3A-3D illustrate the clutch assembly 120 of the system 100. The clutch assembly 120 includes a first lock pin 121, a split ring 122, a retaining member, such as sleeve 123, a biasing member, such as spring 124, a second lock pin 125, and a clutch member 126. The clutch assembly 120 may be disposed on an the outer surface of the mandrel 115 and within the bore of the outer hub 140. The lock pin 121 may be disposed in the longitudinal recess 116. The split ring 122 may be disposed on the outer surface of the mandrel 115. A portion of the split ring 122 may be disposed in the circular groove of the mandrel, longitudinally coupling the split ring 122 to the mandrel 115. The split ring 122 may be formed from two semicircular components held together by screws. An inner surface of the split ring 122 may have a semicircular groove for receiving a portion of the lock pin 121. The first lock pin 121 serves to rotationally couple the mandrel 115 to the split ring 122. The split ring 122 may include a shoulder. The shoulder may have a lip disposed on an inner surface thereof. The sleeve 123 may be a thin walled ring and have a bore therethrough. The sleeve 123 may be disposed around the outer surface of the mandrel 115. The sleeve 123 may have a shoulder formed at a longitudinal end thereof. The shoulder of the sleeve 123 may extend into the split ring 122 and rest on the lip.

The spring 124 may be disposed about the circumference of the mandrel 115. A portion of the sleeve 123 may be disposed between the spring 124 and the outer circumference of the mandrel 115. Spring 124 may engage an outer face of the shoulder of the split ring 122. The spring 124 may engage an outer face of the clutch member 126 at an opposite end from the shoulder of the split ring 122. The spring 124 serves to bias the clutch member 126 towards a corresponding engagement member 131 of the inner housing 130. The clutch member 126 may be disposed around the outer circumference of the mandrel 115. The clutch member 126 may have at least one threaded hole formed through a wall thereof. The second lock pin 125 may be coupled to the clutch member 126 by the threaded hole. The second lock pin 125 may be partially disposed in the longitudinal slot 117 of the mandrel 115. The second lock pin 125 serves to rotationally couple the mandrel 115 to the clutch member 126. The clutch member 126 may have at least one tab 127 formed at a longitudinal end thereof. The tab 127 may have a trapezoidal profile including tapered sides. Alternatively, the tab 127 may only have a single tapered side in the direction of rotation of the mandrel 115. The clutch member 126 may be movable between a locked or engaged position (FIG. 3A, 3B), wherein the inner housing 130 is rotationally coupled to the mandrel 115, and an unlocked or disengaged position (FIG. 3C), wherein the mandrel 115 is allowed to rotate relative to the inner housing 130. The tab 127 may be configured to engage an engagement member 131 of the inner housing 130.

Figure 3A:
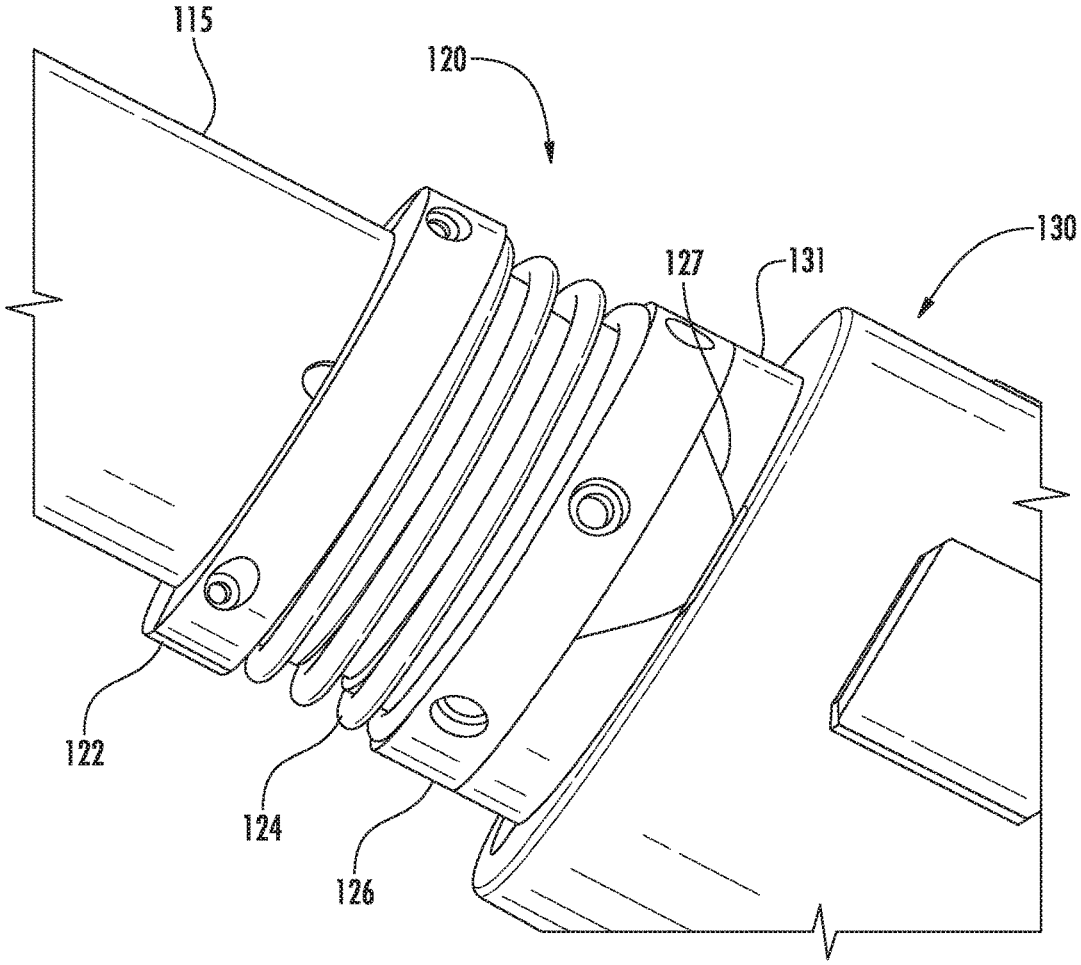
FIG. 3A is a perspective view of a clutch assembly of the tension cutting casing and wellhead retrieval system.
Figure 3B:
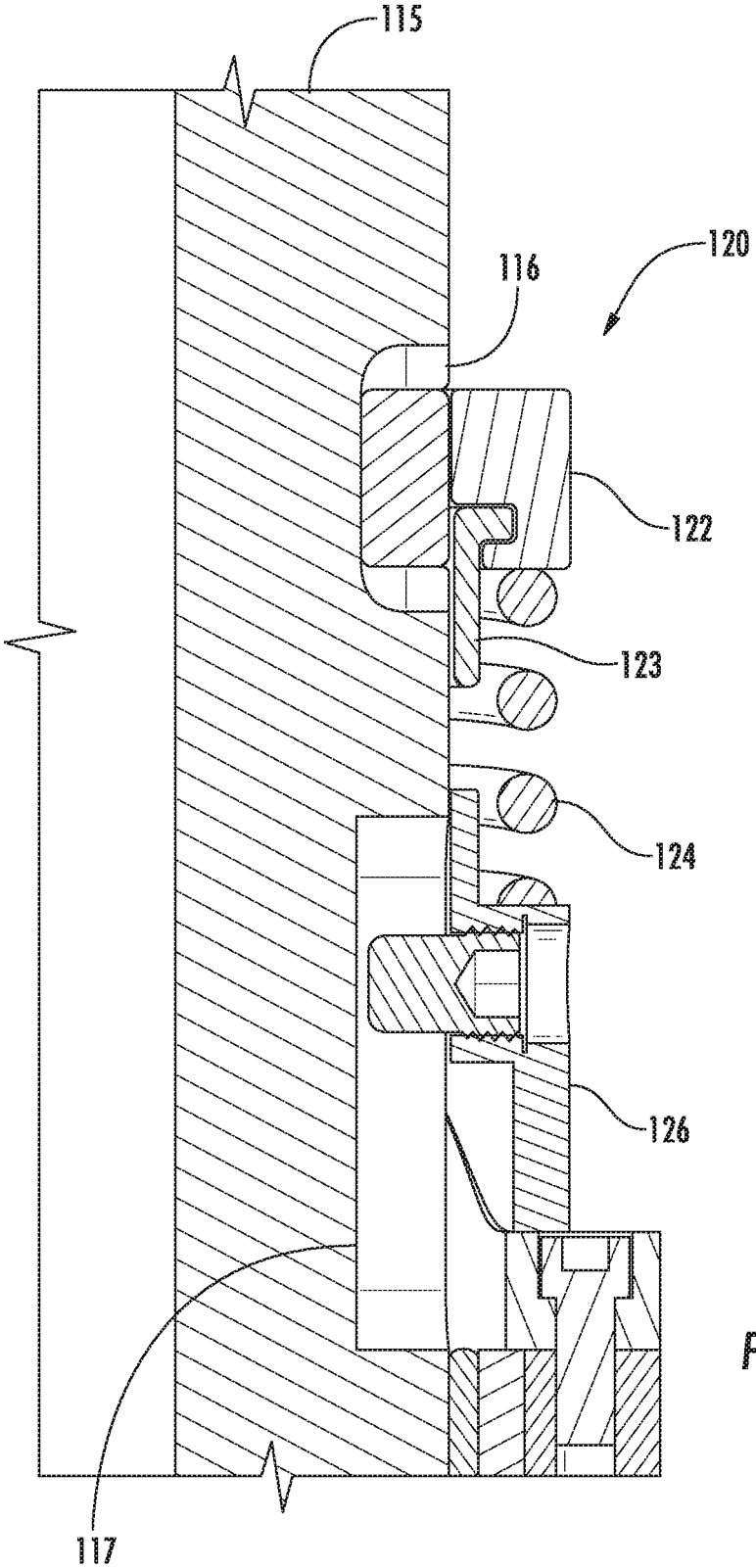
FIGS. 3B and 3C are longitudinal cross section views of the clutch assembly of the tension cutting casing and wellhead retrieval system.
Figure 3C:
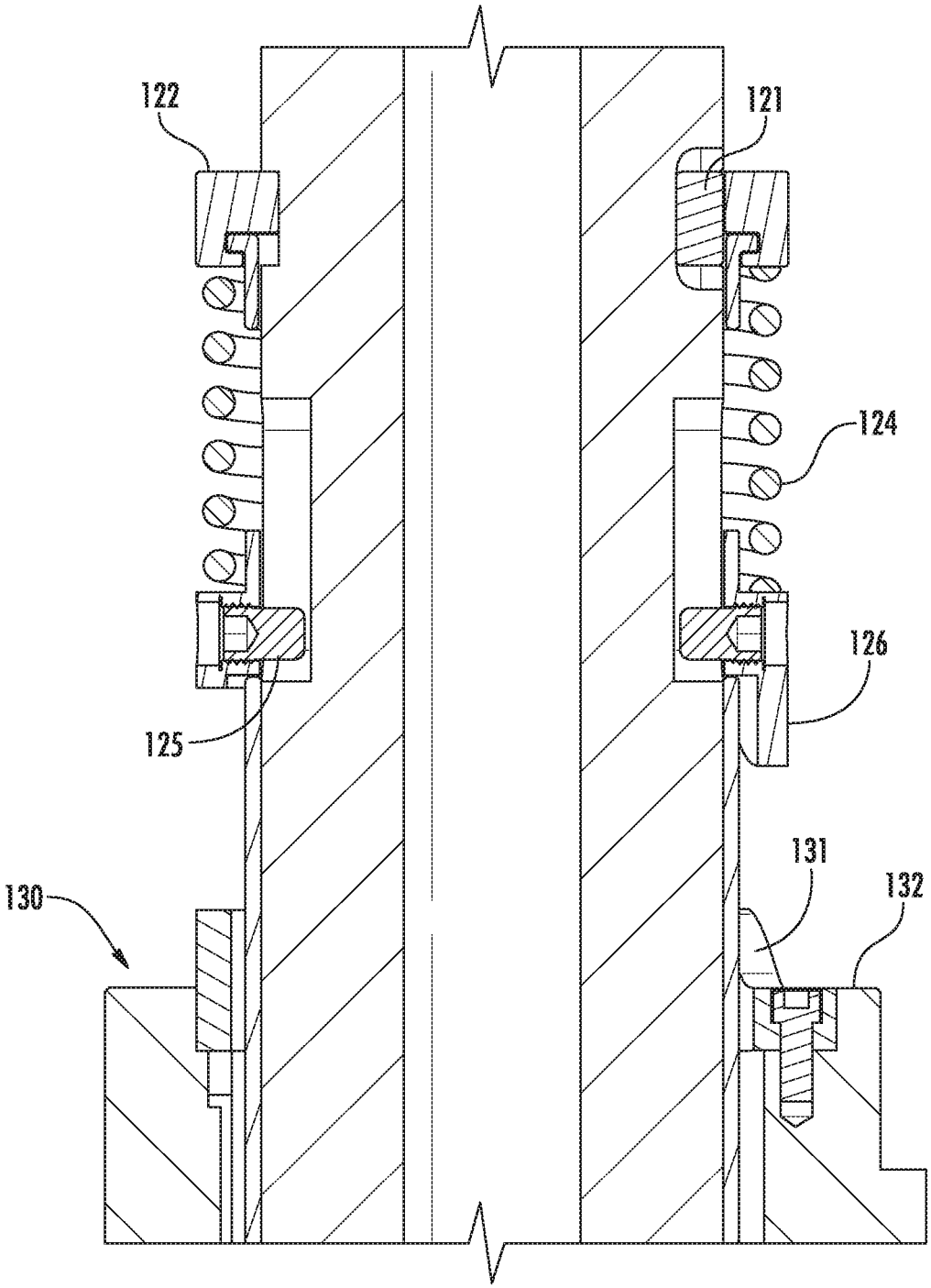
Figure 3D:
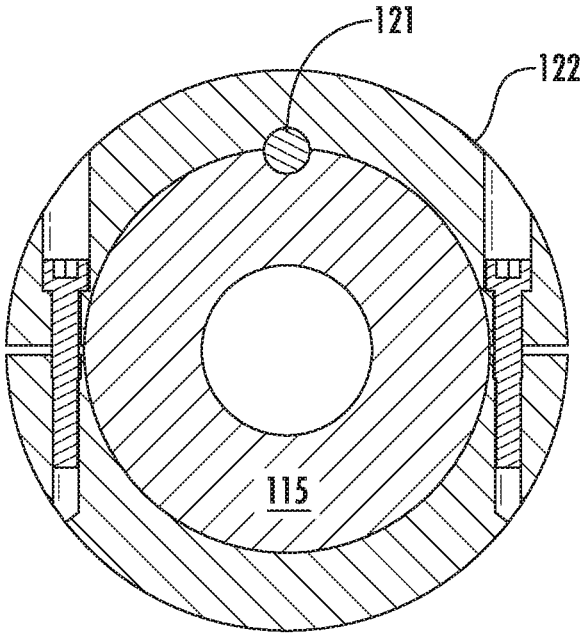
FIG. 3D is a radial cross section view of a split ring of the clutch assembly.
Figure 4:
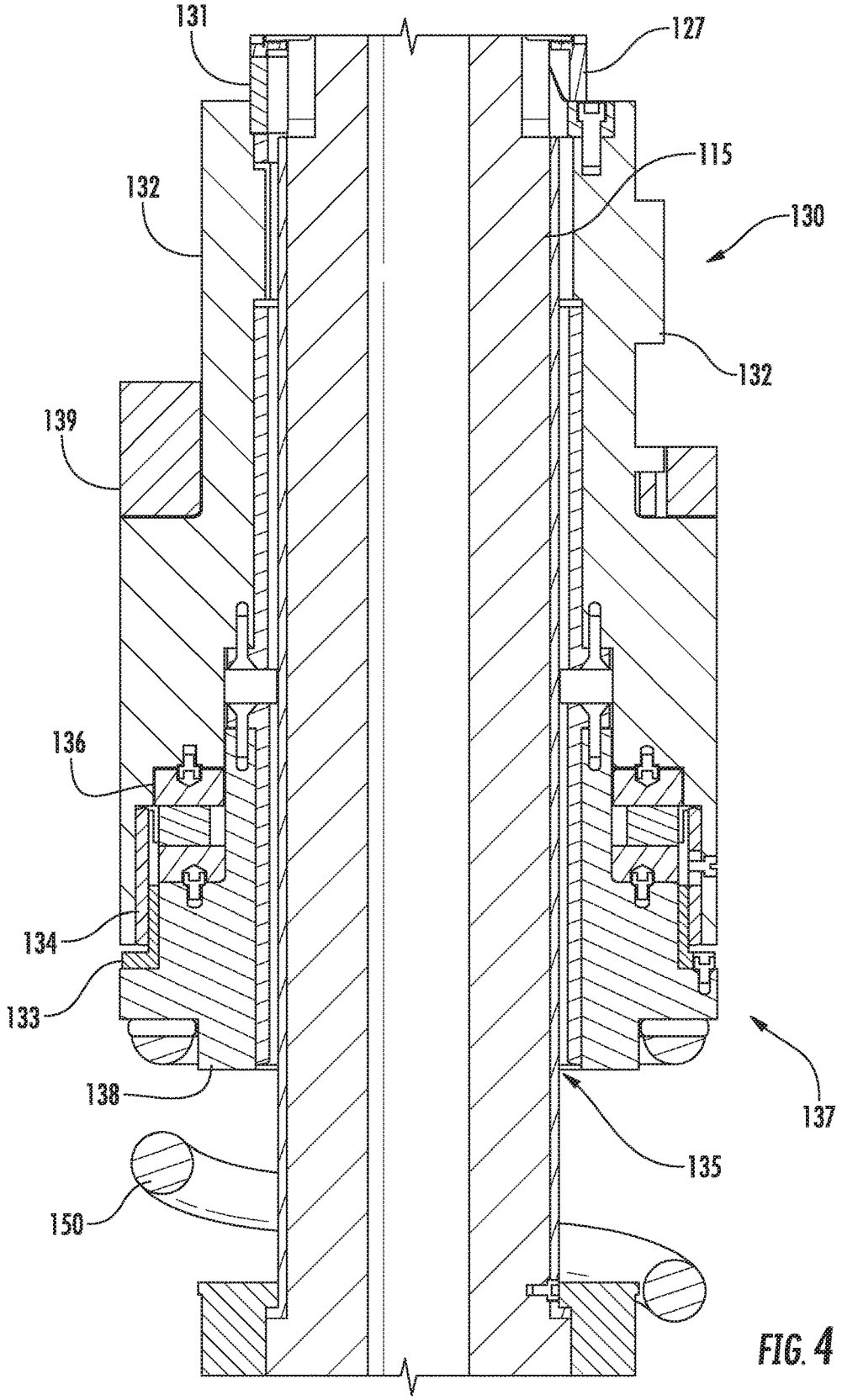
FIG. 4 is a cross section view of a housing of the tension cutting casing and wellhead retrieval system.

FIG. 4 illustrates the inner housing 130 of the system 100. The inner housing 130 may be disposed about the circumference of the mandrel 115. The mandrel 115 may be at least partially disposed in a bore of the inner housing 130. The housing may include an engagement member 131 (also shown in FIG. 3A), a housing section 132, and a sleeve member 134. The engagement member 131 may be tubular and disposed about the circumference of the mandrel 115. The engagement member 131 may be located at a longitudinal end of the inner housing 130. The engagement member 131 may have an opening 131*p* (FIG. 3C) with tapered sides corresponding to the tapered sides of the tab 127. The corresponding tapered sides of the tab 127 may be configured to engage the tapered sides of the engagement member 131. The corresponding tapered sides of the engagement member 131 may facilitate the tab 127 to catch in the opening 131*p*, rotationally coupling the mandrel 115 and inner housing 130. The engagement member 131 may be coupled to the housing section 132 by a screw. The housing section 132 may be tubular and have a bore formed therethrough. The housing section 132 may be disposed about the circumference of the mandrel 115. The inner surface of the housing section 132 may have a stepped profile, including a series of shoulders formed along the inner surface. The housing section 132 may include at least one locking member, such as locking lug 132*s*, formed along an outer surface thereof. The locking lug 132*s* may engage the arm 143. A plurality of locking lugs may be disposed circumferentially about the housing section 132. Each locking lug 132*s* may correspond and engage with one of the arms 143. Sleeve member 134 may be a thin walled ring. Sleeve member 134 may engage an inner surface of the housing section 132. Sleeve member 134 may be coupled to the housing section 132 by a screw.

Cap section 137 may be disposed at a longitudinal end of the housing section 132 opposite of the engagement member 131. Cap section 137 may include a cap member 138 and bushing 133. Cap member 138 may be tubular and have a bore therethrough. Cap member 138 may be disposed about the mandrel 115. Cap member 138 may have a stepped profile, including a series of shoulders along an outer surface thereof. An outer shoulder may be formed at a longitudinal end of the cap member 138 opposite of the inner housing 130. Bushing 133 may be a thin walled ring having a lip formed at a longitudinal end thereof. The lip of bushing 133 may engage the stepped profile of the cap member 138. The bushing 133 may be coupled to the cap member 138 by a screw.

Bearing 135 may be disposed about the circumference of the mandrel 115. Bearing 135 may be a marine bearing. Bearing 135 facilitates longitudinal movement of the mandrel 115 relative to the inner housing 130. Bearing 135 may include an inner lining and a housing. The inner lining may be disposed about the circumference of the mandrel 115 and longitudinally and rotationally coupled to the mandrel 115 by a screw. The inner lining protects an outer surface of the mandrel 115 during longitudinal movement of the mandrel 115 through the bore of the housing section 132. A portion of the inner lining may be disposed between the first retaining member 146 and the mandrel 115. The housing may include two sections. A first section may be coupled to a shoulder of the stepped profile of the housing section 132 by a screw. The second section may be coupled to a shoulder of the stepped profile of the cap member 137. Fluid, such as seawater, may be allowed to flow through the opening between the inner lining and the housing and provide lubrication to bearing 135.

Bearing 136 may be disposed between the housing section 132 and the cap member 137. Bearing 136 may be a polycrystalline diamond bearing. Bearing 136 may include an upper race and a lower race. The upper race may be rotationally coupled to the housing section 132. The lower race may be rotationally coupled to the cap member 137. Bearing 136 permits rotation of the cap section 137 and the mandrel 115 relative to the inner housing 130. When the clutch assembly 120 is in a disengaged position, the bearing 136 permits rotation of the cap section 137 and the mandrel 115 relative to the inner housing 130. Bearing 136 supports an axial load when tension is applied to the mandrel 115 by an upward force applied to the work string.

Referring to FIGS. 2A and 4, spring 150 may be disposed about the circumference of the mandrel 115. Spring 150 may engage the outer shoulder of the cap member 138 at one longitudinal end. Spring 150 may engage the second retaining member 147 at an opposite longitudinal end. Spring 150 may support the weight of the cap section 137, inner housing 130, and outer hub 140. The spring 150 may be compressed by applying tension to the mandrel 115. Tension is applied to the mandrel 115 by an upward force applied to the work string. The spring 150 is compressed until the first retaining member 146 engages the shoulder 138*s* of the cap member 138, preventing further longitudinal movement of the mandrel 115 relative to the cap section 137 and inner housing 130.

Referring to FIG. 1B, in operation, the system 100 is lowered via the work string until the system 100 is positioned proximate the top of the wellhead 10 disposed on the seafloor 20. Alternatively, the wellhead may be located at the surface. As the system 100 is positioned relative to the wellhead 10, the rotary cutter assembly 105 is lowered into the wellhead 10 such that the blades 110 of the rotary cutter assembly 105 are adjacent the casing string 30 attached to the wellhead 10.

Referring now to FIGS. 3A-5B, after positioning the system 100 proximate the wellhead 10, the inner housing 130 and mandrel 115 are rotated by the work string. The clutch assembly 120 is in an engaged position or locked position (FIGS. 3A, 3B, and 5A), wherein the mandrel 115 and inner housing 130 are rotationally coupled. The inner housing 130 and mandrel 115 are rotated relative to the outer hub 140 and the arm 143. The locking lug 132*s* of the housing section 132 is rotated into alignment with one of the arms 143. Stops 139 disposed on an outer surface of the housing section 132 may prevent further rotation of the inner housing 130 relative to the outer hub 140 once the locking lug 132*s* is aligned with the arm 143. Stops 139 contact a corresponding profile on the hub 140 to prevent further rotation of the inner housing 130 relative to the outer hub 140. A first axial force is then applied to the mandrel 115 by applying an upward force to the work string at the surface. The upward force is applied to the work string by the top drive or other traveling member. The first axial force causes the mandrel 115 and inner housing 130 to move longitudinally with respect to the arm 143 and the outer hub 140. The locking lug 132*s* disposed on the outer surface of the inner housing 130 moves longitudinally towards the arm 143. The locking lug 132*s* pushes against a lower end of the arm 143, causing the arm 143 to pivot and engage the wellhead 10 thereby attaching the system 100 to the wellhead 10. The locking lug 132*s* continues moving longitudinally until aligned with a circumferential lock slot formed in the inner surface of the outer hub 140. At this point, the clutch assembly 120 is still in the engaged position. Further rotation of the mandrel 115 by the work string causes the locking lug 132*s* to enter the lock slot of the outer hub 140 thereby longitudinally coupling the inner housing 130 to the outer hub 140 and locking the arms 143 securely to the wellhead 10.

Figure 5A:
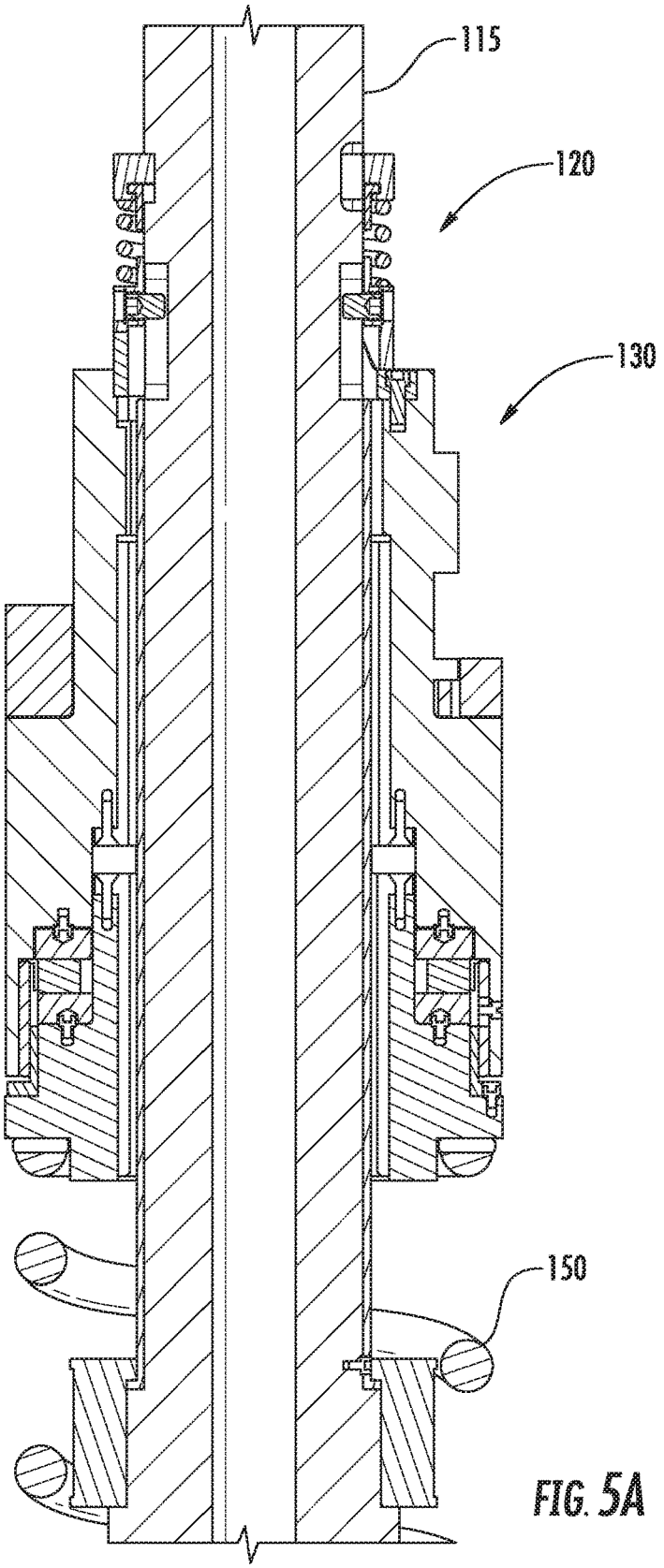
FIG. 5A-5B illustrate the operation of the clutch assembly.
Figure 5B:
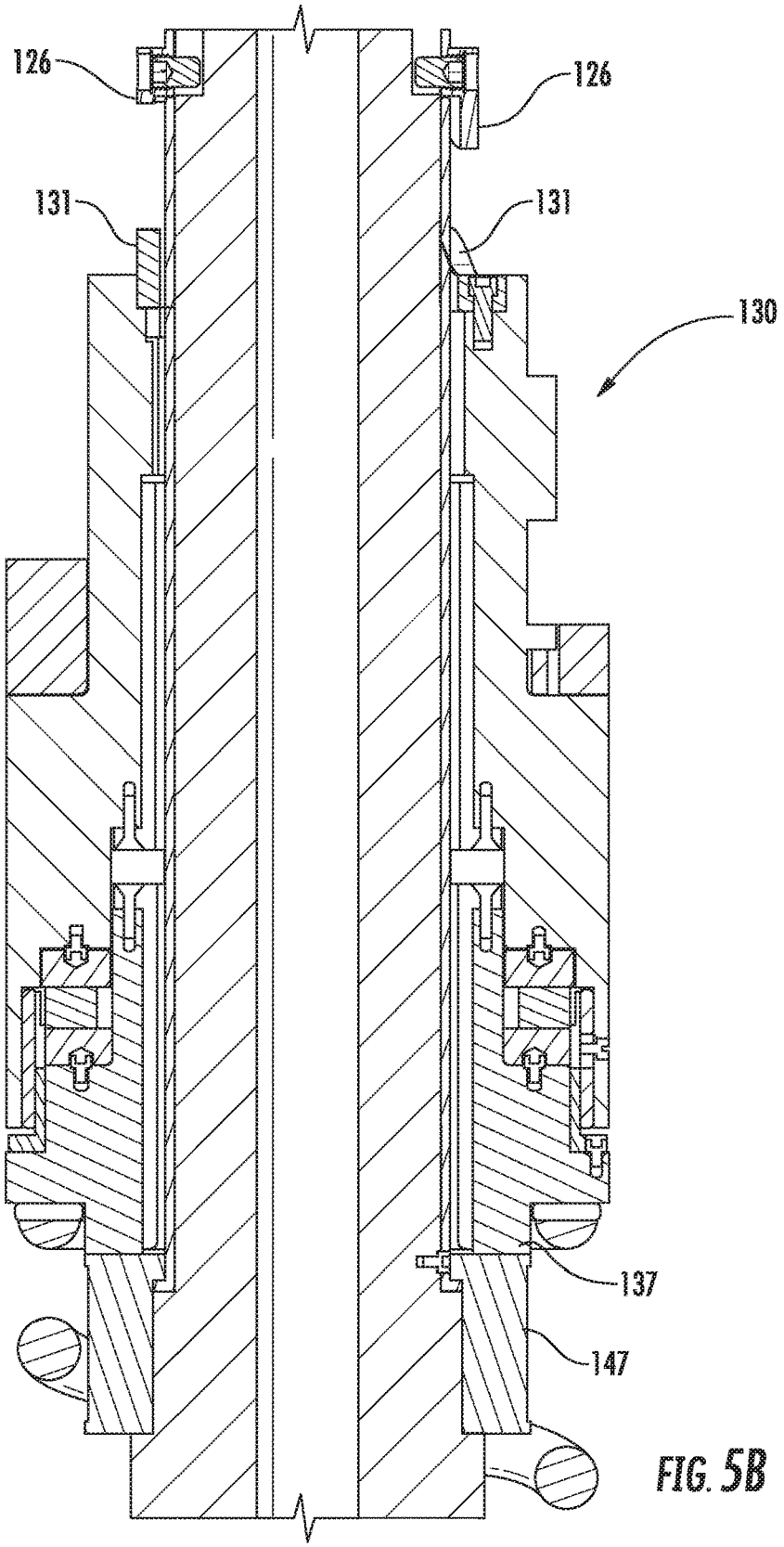

A second axial force applied to the mandrel 115 decouples the clutch assembly 120, rotationally decoupling the inner housing 130 from the mandrel 115. The second axial force may be the same as or greater than the first axial force. As shown in FIGS. 3C and 5B, the clutch assembly is moved to a disengaged or unlocked position. Spring 124 biases the clutch member 126 and second lock pin 125 towards a lower end of slot 117. The second axial force applied to the mandrel 115 by the work string moves the tubular mandrel 115 longitudinally through the bore of the inner housing 130. After the second lock pin reaches the lower end of slot 117, a shoulder of the slot 117 engages and lifts the second lock pin 125 to move with the tubular mandrel 115. The tubular mandrel 115 carries the second lock pin 125 and clutch member 126 upwards. The movement of the mandrel 115 disengages the clutch member 126 from the engagement member 131. The profile 126*p* of the clutch member 126 moves out of the open profile 131*p* of the engagement member 131, rotationally decoupling the inner housing 130 from the mandrel 115. The mandrel 115 is now allowed to rotate relative to the inner housing 130, outer hub 140, and wellhead 10.

Next, a third axial force may be applied to the wellhead. The third axial force may be the same or greater than each of the first and second axial force. The top drive or other traveling member applies the third axial force to the work string. The third axial force is transferred and applied to the tubular mandrel 115 via the coupling with the work string. The third axial force causes the mandrel 115 to move longitudinally relative to the inner housing 130, outer hub 140, and wellhead 10. The mandrel 115 moves longitudinally through the bore of the inner housing 130 until the first retaining member 146 engages cap member 138. Engagement of the first retaining member 146 with the cap member 138 longitudinally couples the inner housing 130 to the mandrel 115. As a result, the force applied to the mandrel 115 through the work string is transferred through the first retaining member 146 to the inner housing 130 via cap member 138. The mandrel 115 is prevented from further longitudinal movement relative to the inner housing 130 by the engagement of the first retaining member 146 with the cap member 138. The longitudinal restriction places the mandrel 115 in tension as the traveling member continues to apply the axial force through the work string. The tension is transferred to the inner housing 130 from the engagement with the cap member 138. The tension applied to the tubular mandrel 115 is further transferred from the inner housing 130 to the arm 143 via the engagement of the arm 143 with the locking lug 132*s*. Finally, the wellhead 10 is placed in tension due to the engagement and attachment of the arm 143 to the wellhead 10. The tension applied to the wellhead 10 is transferred to the attached casing string 30 via a coupling with the wellhead 10. The tension applied to the wellhead 10 may be useful during the cutting operation because tension in the casing string 30 typically prevents the blades 110 of the rotary cutter assembly 105 from jamming (or becoming stuck) as the blades 110 cut through the casing string 30.

Alternatively, if the inner housing 130 is not engaged and attached to the wellhead 10 by the arm 143, then the engagement of the first retaining member 146 with the cap member 138 causes the system 100 to lift from the wellhead 10.

After the inner housing 130, outer hub 140, and wellhead 10 have been rotationally decoupled from the mandrel 115 and tension is applied to the casing string 30, the casing string 30 is cut. The traveling member or top drive begins rotating the work string. The mandrel 115 is rotated by the work string while tension is applied to the wellhead 10. The mandrel 115 is rotated relative to the inner housing 130, outer hub 140, and wellhead 10. The mandrel 115 is rotated while the arm 143 engages and attaches the outer hub 140 to the wellhead 10. Rotation of the mandrel 115 is transferred to the downhole assembly to perform an operation in the well. For example, rotation of the mandrel 115 is transferred to the rotary cutter assembly 105 positioned adjacent the casing string 30. The rotary cutter assembly 105 continues to operate until a lower portion of the casing string 30 is disconnected from an upper portion of the casing string 30. At this point, the rotary cutter assembly 105 is deactivated by stopping rotation of the work string. After the casing string 30 is cut, the system 100, the wellhead 10, and the upper portion of the casing string 30 above the cut are lifted from the seafloor 20 by applying an upward force on the work string. The system 100, wellhead 10, and the upper portion of the casing string 30 are retrieved to the surface.

Alternatively, the casing string 30 may be cut without tension. Cutting the casing string 30 may follow the same process described above to disengage the clutch assembly 120. The spring 150 supports a weight of the inner housing 130 and outer hub 140. The first retaining member 146 is not engaged with the cap member 138 to transfer the third axial force to the inner housing 130. Thus, the wellhead 10 and casing string 30 are not placed in tension. The traveling member or top drive begins rotating the work string. The mandrel 115 is rotated relative to the inner housing 130, outer hub 140, and wellhead 10. The mandrel 115 is rotated while the arm 143 engages and attaches the outer hub 140 to the wellhead 10. Rotation of the mandrel 115 is transferred to the downhole assembly to perform an operation in the well. For example, rotation of the mandrel 115 is transferred to the rotary cuter assembly 105 positioned adjacent the casing string 30. The rotary cutter assembly 105 continues to operate until a lower portion of the casing string 30 is disconnected from an upper portion of the casing string 30. At this point, the rotary cutter assembly 105 is deactivated by stopping rotation of the work string. After the casing string 30 is cut, the system 100, the wellhead 10, and the upper portion of the casing string 30 above the cut are lifted by applying an upward force on the work string. The system 100, wellhead 10, and the upper portion of the casing string 30 are retrieved to the surface.

In one embodiment, an apparatus for use in a well includes a tubular mandrel configured to connect to a downhole assembly, an outer hub having a bore therethrough and configured to attach to a wellhead, an inner housing disposed on the tubular mandrel and configured to attach the outer hub to the wellhead, and a clutch assembly disposed within the bore of the outer hub and movable between a locked position and an unlocked position, wherein the tubular mandrel is rotatable relative to the inner housing to operate the downhole assembly in the unlocked position.

In one or more of the embodiments described herein, the downhole assembly is operable to perform an operation in the well.

In one or more of the embodiments described herein, the downhole assembly includes a rotary cutter assembly operable to cut a casing string disposed in the well.

In one or more of the embodiments described herein, the clutch assembly is movable to the locked position to rotationally couple the tubular mandrel to the inner housing.

In one or more of the embodiments described herein, the tubular mandrel is longitudinally movable to move the clutch assembly to the unlocked position.

In one or more of the embodiments described herein, the tubular mandrel is longitudinally movable to apply an axial force to the wellhead.

In one or more of the embodiments described herein, the clutch assembly includes a biasing member operable to bias the clutch assembly to the locked position.

In one or more of the embodiments described herein, the outer hub further comprises a latch member movable to a latched position with an outer surface of the wellhead.

In another embodiment, a method of performing an operation in a well includes attaching a tool to a wellhead, wherein the tool comprises an inner housing and an outer hub and is connected to a tubular mandrel, applying an axial force to the tubular mandrel to disengage a clutch assembly disposed within a bore of the outer hub, and rotating the tubular mandrel relative to the tool thereby operating a downhole assembly.

In one or more of the embodiments described herein, the method includes rotating the tubular mandrel relative to the inner housing while applying the axial force to the tubular mandrel.

In one or more of the embodiments described herein, operating the downhole assembly includes cutting a casing string attached to the wellhead.

In one or more of the embodiments described herein, the method includes releasing the axial force to engage the clutch assembly with the tubular mandrel.

In one or more of the embodiments described herein, the method includes biasing the clutch assembly to an engaged position with the tubular mandrel.

In one or more of the embodiments described herein, the method includes rotating the inner housing using the tubular mandrel.

In one or more of the embodiments described herein, applying a second axial force to the tubular mandrel to attach the tool to the wellhead.

In one or more of the embodiments described herein, moving the tubular mandrel longitudinally relative to the tool to disengage the clutch assembly.

In one or more of the embodiments described herein, attaching the tool to the wellhead further comprises rotating the tubular mandrel relative to the outer hub and applying an axial force to the outer hub using the tubular mandrel.

In one or more of the embodiments described herein, attaching the tool to the wellhead includes moving a latch member to a latched position with an outer surface of the wellhead.

In one or more of the embodiments described herein, attaching the tool to the wellhead includes engaging a profile on the outer surface of the wellhead with the latch member.

In another embodiment, an apparatus for use in a well includes a tubular mandrel configured to connect to a downhole assembly, an outer hub having a bore therethrough and configured to attach to a wellhead, an inner housing disposed on the tubular mandrel and configured to attach the outer hub to the wellhead, and a clutch assembly configured to engage the inner housing and rotationally couple the inner housing to the tubular mandrel in a locked position.

In one or more of the embodiments described herein, the inner housing is at least partially disposed within the bore of the outer hub.

In one or more of the embodiments described herein, the clutch assembly further includes a clutch member disposed on an outer surface of the tubular mandrel.

In one or more of the embodiments described herein, the clutch assembly further comprises a biasing member configured to bias the clutch member towards an engaged position.

In another embodiment, a method of performing an operation in a well includes attaching a tool to a wellhead, wherein the tool comprises an inner housing and an outer hub and is configured to connect to a tubular mandrel, moving the tubular mandrel relative to the wellhead to apply an axial force to the wellhead, and rotating the tubular mandrel to operate the downhole assembly while applying the axial force to the wellhead.

In one or more of the embodiments described herein, operating the downhole assembly includes cutting a casing string attached to the wellhead.

In one or more of the embodiments described herein, the method includes moving the tubular mandrel relative to the tool to disengage a clutch assembly of the tool.

In one or more of the embodiments described herein, the method includes retrieving the tool and the wellhead from the well.

In one or more of the embodiments described herein, attaching the tool to the wellhead includes rotating the tubular mandrel relative to the tool and applying an axial force to the tool using the tubular mandrel.

In one or more of the embodiments described herein, attaching the tool to the wellhead includes moving a latch member to a latched position with an outer surface of the wellhead.

In one or more of the embodiments described herein, attaching the tool to the wellhead includes engaging a profile on the outer surface of the wellhead with the latch member.

In another embodiment, an apparatus for use in a well includes a tubular mandrel, a housing disposed about the tubular mandrel, a latch member for engaging a subsea wellhead, and a clutch assembly rotationally coupling the tubular mandrel to the housing and movable to an unlocked position wherein the tubular mandrel is allowed to rotate relative to the housing.

In one or more of the embodiments described herein, the clutch assembly includes a tab having a profile.

In one or more of the embodiments described herein, the clutch assembly includes a biasing member, wherein the clutch assembly is biased towards a locked position wherein the tubular mandrel is rotationally coupled to the housing.

In one or more of the embodiments described herein, the housing includes an engagement member having a corresponding profile to the profile of the tab.

In one or more of the embodiments described herein, the housing includes a locking member rotatable relative to the latch member.

In one or more of the embodiments described herein, an apparatus for use in a subsea well includes a retention member disposed on the tubular mandrel.

In one or more of the embodiments described herein, an apparatus for use in a subsea well includes a biasing member, wherein the housing is biased towards the clutch assembly.

In one or more of the embodiments described herein, the tubular mandrel is rotatable relative to the latch member when the latch member is in a latched position with the subsea wellhead.

In one or more of the embodiments described herein, the housing is longitudinally movable relative to the tubular mandrel to a shouldered position.

In one or more of the embodiments described herein, the housing engages the retention member in the shouldered position thereby preventing further longitudinal movement of the housing relative to the tubular mandrel.

In another embodiment, a method of latching to a subsea wellhead includes positioning a tool proximate a subsea wellhead, the tool comprising at least one latch member and at least one locking member, rotating the locking member relative to the latch member, and moving the at least one latch member from an unlatched position to a latched position in which the latch member engages the subsea wellhead.

In one or more of the embodiments described herein, a method of latching to a subsea wellhead includes engaging the at least one locking member with the at least one latch member to move the at least one latch member to the latched position.

In one or more of the embodiments described herein, a method of latching to a subsea wellhead includes wherein the tool further includes a mandrel and a clutch assembly.

In one or more of the embodiments described herein, a method of latching to a subsea wellhead includes operating the clutch assembly to rotationally decouple the mandrel from the locking member.

In one or more of the embodiments described herein, a method of latching to a subsea wellhead includes applying an upward force to the tool to engage the at least one locking member with the at least one latch member.

In one or more of the embodiments described herein, a method of latching to a subsea wellhead includes cutting a casing string attached to the subsea wellhead In one or more of the embodiments described herein, a method of latching to a subsea wellhead includes retrieving the tool and the subsea wellhead from a subsea well.

In one or more of the embodiments described herein, a method of latching to a subsea wellhead includes rotating the mandrel relative to the at least one latch member.

In one or more of the embodiments described herein, a method of latching to a subsea wellhead includes moving the mandrel longitudinally relative to the latch member.

In one or more of the embodiments described herein, a method of latching to a subsea wellhead includes applying an upward force to the subsea wellhead.

In one or more of the embodiments described herein, a method of latching to a subsea wellhead includes wherein the tool further includes a housing longitudinally coupled to the latch member.

In one or more of the embodiments described herein, a method of latching to a subsea wellhead includes moving the housing longitudinally to a shouldered position to longitudinally couple the housing to the mandrel.

In another embodiment, an apparatus for use with a subsea wellhead includes a tubular mandrel, a latch member disposed about the tubular mandrel and movable between an unlatched position and a latched position, wherein the latch member engages the subsea wellhead, and a locking member rotatable relative to the latch member.

In one or more of the embodiments described herein, the apparatus includes a clutch assembly rotationally coupling the tubular mandrel to the locking member and movable to an unlocked position wherein the tubular mandrel is rotatable relative to the locking member.

In one or more of the embodiments described herein, the apparatus includes a housing disposed about the tubular mandrel, wherein the tubular mandrel is rotatable relative to the housing.

In another embodiment, a method of performing an operation in a subsea well includes positioning a tool proximate a subsea wellhead, wherein the tool has at least one latch member and a locking member, and wherein the tool is attached to a downhole assembly, rotating the locking member relative to the latch member, moving the at least one latch member from an unlatched position to a latched position in which the at least one latch member engages the subsea wellhead, performing the operation in the subsea well by utilizing the downhole assembly.

In one or more of the embodiments described herein, the operation includes cutting a casing string.

While the foregoing is directed to embodiments of the present invention, other and further embodiments of the invention may be devised without departing from the basic scope thereof, and the scope thereof is determined by the claims that follow.

The invention claimed is:

1. An apparatus for use in a well, comprising:

a tubular mandrel configured to connect to a downhole assembly;

an outer hub having a bore therethrough and a latch member configured to attach to a wellhead;

an inner housing disposed on the tubular mandrel and configured to attach the outer hub to the wellhead, wherein the inner housing is at least partially disposed in the outer hub; and a clutch assembly disposed within the bore of the outer hub and movable between a locked position and an unlocked position, wherein the tubular mandrel is rotatable relative to the inner housing to operate the downhole assembly in the unlocked position.

2. The apparatus of claim 1, wherein the downhole assembly is operable to perform an operation in the well.

3. The apparatus of claim 2, the downhole assembly further comprising a rotary cutter assembly operable to cut a casing string disposed in the well.

4. The apparatus of claim 1, wherein the clutch assembly is movable to the locked position to rotationally couple the tubular mandrel to the inner housing.

5. The apparatus of claim 1, wherein the tubular mandrel is longitudinally movable to move the clutch assembly to the unlocked position.

6. The apparatus of claim 1, wherein the tubular mandrel is longitudinally movable to apply an axial force to the wellhead.

7. The apparatus of claim 6, the clutch assembly further comprising a biasing member operable to bias the clutch assembly to the locked position.

8. The apparatus of claim 7, further comprising a second biasing member for biasing the inner housing.

9. A method of performing an operation in a well, comprising:

attaching a tool to a wellhead, wherein the tool comprises a tubular mandrel, an inner housing and an outer hub having one or more latch members for attaching to the wellhead;

biasing a clutch assembly disposed within a bore of the outer hub to an engaged position;

rotating the inner housing using the tubular mandrel;

applying an axial force to the tubular mandrel to disengage the clutch assembly, thereby releasing the tubular mandrel to rotate and longitudinally move relative to the inner housing; and rotating the tubular mandrel relative to the inner housing thereby operating a downhole assembly.

10. The method of claim 9, wherein the tubular mandrel is rotated relative to the inner housing while applying the axial force to the tubular mandrel.

11. The method of claim 9, wherein operating the downhole assembly comprises cutting a casing string attached to the wellhead.

12. The method of claim 9, further comprising releasing the axial force to engage the clutch assembly with the tubular mandrel.

13. The method of claim 9, wherein attaching the tool comprises applying a second axial force to the tubular mandrel to attach one or more latch members of the tool to the wellhead.

14. The method of claim 13, further comprising moving the tubular mandrel longitudinally relative to the inner housing to disengage the clutch assembly.

15. The method of claim 9, wherein attaching the tool to the wellhead further comprises:

rotating the tubular mandrel relative to the outer hub; and applying a second axial force to the outer hub using the tubular mandrel.

16. The method of claim 9, wherein attaching the tool to the wellhead further comprises:

moving a latch member to engage a profile on an outer surface of the wellhead.

17. The method of claim 9, further comprising biasing the inner housing longitudinally relative to the tubular mandrel.

18. An apparatus for use in a well, comprising:

a tubular mandrel configured to connect to a downhole assembly;

an outer hub having a bore therethrough and a latch member configured to attach to a wellhead;

an inner housing disposed on the tubular mandrel and configured to attach the outer hub to the wellhead; and a clutch assembly, when in a locked position, configured to engage the inner housing and rotationally couple the inner housing to the tubular mandrel, wherein the clutch assembly includes:

a clutch member disposed on an outer surface of the tubular mandrel; and a biasing member configured to bias the clutch member towards the inner housing.

19. The apparatus of claim 18, wherein the inner housing is at least partially disposed within the bore of the outer hub.

20. A method of performing an operation in a well, comprising:

attaching a tool to a wellhead, wherein the tool comprises a tubular mandrel, an inner housing and an outer hub having one or more latch members for attaching to the wellhead;

applying an axial force to the tubular mandrel to disengage a clutch assembly disposed within a bore of the outer hub, thereby releasing the tubular mandrel to rotate and longitudinally move relative to the inner housing;

rotating the tubular mandrel relative to the inner housing thereby operating a downhole assembly; and releasing the axial force to engage the clutch assembly with the tubular mandrel.

21. An apparatus for use in a well, comprising:

a tubular mandrel configured to connect to a downhole assembly;

an outer hub having a bore therethrough and a latch member configured to attach to a wellhead;

an inner housing disposed on the tubular mandrel and configured to attach the outer hub to the wellhead, wherein the inner housing is at least partially disposed within the bore of the outer hub; and a clutch assembly, when in a locked position, configured to engage the inner housing and rotationally couple the inner housing to the tubular mandrel.

22. The apparatus of claim 21, further comprising a second biasing member for biasing the inner housing.

* * * * *